United States Patent [19]

Abell

[11] 4,233,785

[45] Nov. 18, 1980

[54] SANDBLASTING APPARATUS

[76] Inventor: Ralph N. Abell, 6685 Main St., Springfield, Oreg. 97477

[21] Appl. No.: 951,153

[22] Filed: Oct. 13, 1978

[51] Int. Cl.[3] ..... B24C 5/04; B24C 7/00

[52] U.S. Cl. ..... 51/427; 51/436; 51/439

[58] Field of Search ..... 51/427, 436, 439; 29/157 C; 239/591

[56] References Cited

U.S. PATENT DOCUMENTS

| | | | |
|---|---|---|---|
| 1,467,488 | 9/1923 | Muste | 51/436 |
| 2,388,818 | 11/1945 | Bick | 51/436 |
| 2,508,766 | 5/1950 | Morel | 51/439 |
| 2,587,184 | 2/1952 | Marjama | 51/439 |
| 3,419,220 | 12/1968 | Goodwin | 51/439 X |
| 3,628,627 | 12/1971 | Arnold | 51/439 |
| 3,644,974 | 2/1972 | Simon | 29/157 C |
| 3,750,340 | 8/1973 | Anderson | 51/436 |

*Primary Examiner*—Gary L. Smith

*Attorney, Agent, or Firm*—James D. Givnan, Jr.

[57] ABSTRACT

A sandblasting apparatus with an abrasive storage tank having a pressure conduit discharging a stream of air proximate to the tank outlet to propel fluidized abrasive particulate toward a Tee whereat the fluidized particles merge with a carrier flow of air for subsequent delivery to a sandblasting gun. The gun is equipped with a nozzle having components joined by silver solder in a manner protecting the components from abrasion.

5 Claims, 5 Drawing Figures

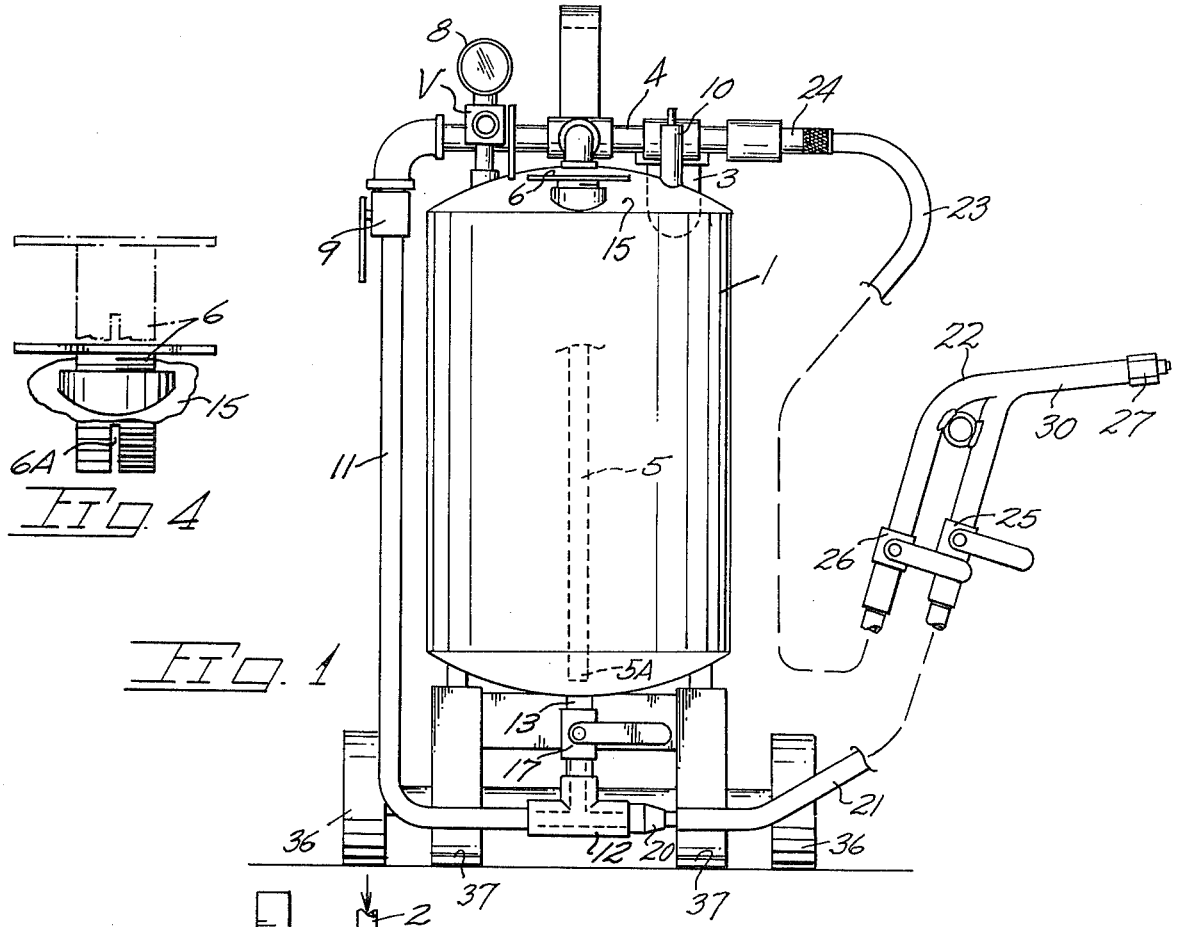
FIG. 1
FIG. 4
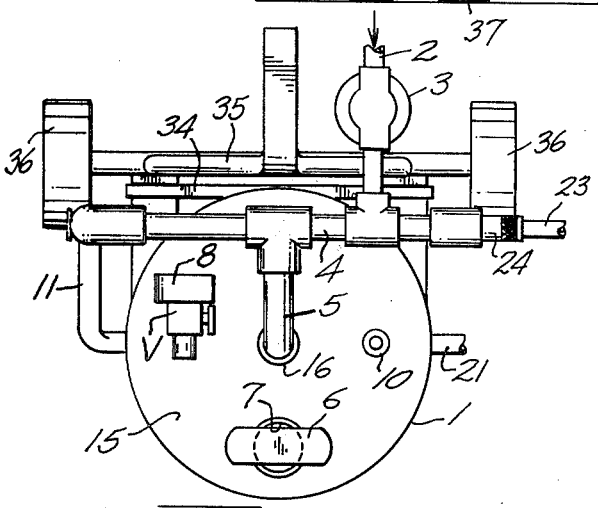
FIG. 2
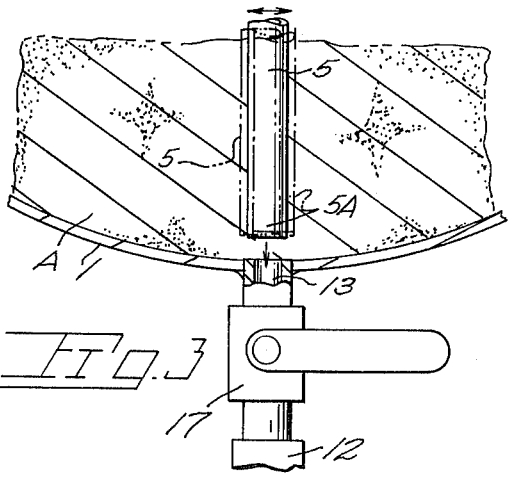
FIG. 3
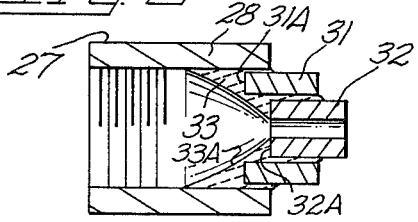
FIG. 5

SANDBLASTING APPARATUS

BACKGROUND OF THE INVENTION

The present invention pertains generally to portable sandblasting equipment for use in small and medium scale sandblasting operations.

Abrasive containing tanks used in sandblasting are susceptible to a bridging condition wherein a void is formed adjacent the outlet of the tank. Toward overcoming this bridging condition, vibrators have been coupled to such tanks at added cost and noise to system operation. Vibration of the tank also necessitates resiliently mounting same also contributing to the overall cost of the abrading system.

Additionally troublesome in existing sandblasting systems is short nozzle life. The use of very hard and costly material such as tungsten carbide alleviates the problem somewhat but contributes significantly to nozzle replacement cost.

SUMMARY OF THE PRESENT INVENTION

The present invention is embodied in a sandblasting system suitable for small scale sandblasting operations such as those conducted in automotive repair shops and in do-it-yourself projects using rental equipment where it is advantageous that the system be easily transportable and of original low cost and low maintenance.

The present system includes a pressurized abrasive storage tank having an inlet conduit terminating within the tank in closely spaced relationship to an abrasive outlet of the tank. The inlet conduit is free standing with its end submerged within the tank stored abrasive. Accordingly, a uniform flow of abrasive material is discharged from the tank past an abrasive control valve to a Tee fitting whereat the tank discharge is mixed with a carrier flow of air for travel to a sandblasting gun.

The gun includes a nozzle of low cost, durable construction utilizing a minimum of costly material but having an operational life at least equivalent to considerably more costly nozzles. A solder formation within the nozzle serves both to unite nozzles components as well as to protect same from abrasion.

Important objectives of the present system include the provision of a storage tank for abrasive material which tank includes a conduit to which motion is imparted by a flow of pressurized air therethrough to contribute toward the prevention of abrasive bridging within the tank; the provision of a system wherein a conduit providing a pressurized airflow to a storage tank terminates proximate the tank outlet so as to agitate and propel abrasive particles from the tank for subsequent entry into a carrier flow of air; the provision of a sandblasting gun having a unitary nozzle of low cost, durable construction.

BRIEF DESCRIPTION OF THE DRAWING

In the accompanying drawing:

FIG. 1 is a front elevational view of the sandblasting system;

FIG. 2 is a top plan view of FIG. 1;

FIG. 3 is an enlarged fragmentary view of the abrasive storage tank with a wall fragment removed for illustrative purposes;

FIG. 4 is a fragmentary elevational view of the tank top end with filter cap;

FIG. 5 is a vertical sectional view of a sandblasting gun nozzle.

DETAILED DESCRIPTION OF THE PREFERRED EMBODIMENTS

With continuing reference to the drawing, the reference numeral 1 indicates an abrasive storage tank in communication with a source of pressurized air as from a medium capacity compressor via a line 2 (FIG. 2), a moisture trap 3, a manifold 4 and an inlet conduit 5.

Tank 1 is fitted with a threaded filler cap 6 in an opening 7. Said cap is slotted at 6A (FIG. 4) for a portion of its length to ensure venting of tank 1 prior to cap removal as a safety precaution. The tank upper end is additionally fitted with a pressure gauge 8 and a safety valve 10. For venting the tank after use, a valve V is provided. Manifold 4 provides what may be termed a carrier flow of pressurized air to a conduit 11 which terminates at mixing means 12 shown as a Tee fitting. A flow control valve 9 regulates carrier flow pressure.

Tank inlet conduit 5 extends axially of the tank 1 and terminates proximate a tank outlet 13. Conduit 5 is free standing at least for a substantial portion of its length and suitably secured to the tank top end wall 15 as by a wall mounted nipple 16. The conduit is approximately of one-half inch inside diameter and two feet or so in length so as to locate the lower or discharge end 5A thereof in closely spaced relationship, say an inch or less, to outlet opening 13.

As viewed in FIG. 3 the conduit 5 discharges into a quantity of abrasive granules A to agitate and fluidize same while simultaneously propelling abrasive particles into outlet 13. Agitation of the abrasive by the discharge flow and conduit vibration precludes any tendency of the material to "bridge".

A valve 17 admits a discharge flow of fluidized abrasive to Tee 12 for mixing with a carrier air flow admitted via line 11. An adapter 20 serves to couple an air abrasive carrying hose 21 to Tee 12 with the hose terminating at a sandblasting gun 22.

A primary air pressure source for gun 22 is provided by an air hose 23 coupled to manifold 4 by a disconnectable coupling 24. Gun 22 is provided with a pair of flow control valves 25 and 26 which regulate, respectively the flow of fluidized abrasive to a gun nozzle 27 and the merging flow of pressurized air to a gun barrel 30. Accordingly, the operator is provided at the gun means to the control of abrasive to air ratio.

Nozzle 27 (FIG. 5) includes a housing 28 partially threaded for securement to barrel 30. Other types of nozzle securement may be utilized. A sleeve at 31 is of alloyed steel and receives a liner 32 which is of extremely hard material such as tungsten carbide or steel alloy. The nozzle parts are joined in an integral manner by a mass of silver solder 33 which has a substantially conical surface 33A axially aligned and converging toward liner 32. During assembly, the silver solder migrates intermediate component surfaces of the nozzle to join same and to overlie the adjacent ends 31A and 32A of sleeve 31 and liner 32 to isolate same from abrasion.

The nozzle so formed is extremely long lived and of low manufactured cost permitting same to be considered a throwaway or disposable item. Costly machining and assembly of nozzle components is avoided by reason of sleeve 31 and liner 32 being cut from tubular stock. A simple soldering operation joins the nozzle components. Liner 32 has, in one practical embodiment, an inside diameter of one-eighth inch and is of Type B tungsten carbide.

To facilitate movement of the apparatus, the same is attached by a crosspiece 34 to a hand truck having frame 35 supported by wheels 36 with stabilizing feet at 37.

While I have shown but one embodiment of the invention it will be apparent to those skilled in the art that the invention may be embodied still otherwise without departing from the spirit and scope of the invention.

Having thus described the invention, what is desired to be claimed and secured under a Letters Patent is:

1. A sandblasting apparatus comprising, an upright abrasive storage tank having an outlet at its lower end, a vibratory conduit supported in a free standing manner by the tank upper end and extending substantially the length of the tank and in communication with a source of air pressure and having its discharge end proximate the tank outlet whereby abrasive particles within the tank are put into a fluid state by inherent operational conduit vibration prior to outward passage through said outlet, mixing means receiving a carrier flow of pressurized air and the fluidized particles discharged from the tank outlet, and a sandblasting gun in communication with said mixing means receiving the fluidized flow of abrasive particles and the carrier air flow, an air hose in communication with a source of air pressure, said gun served by said air hose and receiving a flow of pressurized air for mergence with and propelling of the fluidized abrasive, said sandblasting gun further including a nozzle having a liner, a sleeve disposed concentric about said liner, a housing disposed outwardly of said sleeve, a mass of solder disposed interiorly within said housing serving to permanently join nozzle liner, sleeve and housing and to provide a conical transition surface extending intermediate the housing and the liner.

2. The apparatus claimed in claim 1 wherein said mass of solder overlies end surfaces of said sleeve and liner to protect same from abrasion.

3. A nozzle for a sandblasting gun comprising a housing, a sleeve partially within said housing, a liner concentric with said sleeve, a mass of solder within said housing and joining said liner and sleeve to one another and to said housing, said mass of solder having a substantially conical continuous inner surface constituting a transition surface directing particle flow into said liner.

4. The nozzle claimed in claim 3 wherein said mass of solder overlies end surfaces of said sleeve and liner to protect same from abrasion.

5. The nozzle claimed in claim 4 wherein the solder is silver solder.

* * * * *